United States Patent [19]

Vokurka

[11] 4,024,543

[45] May 17, 1977

[54] PARABOLIC ANTENNA

[76] Inventor: Vaclav Josef Vokurka, 18, Van Hallstraat, Son en Breugel, Netherlands

[22] Filed: July 23, 1976

[21] Appl. No.: 708,177

[30] Foreign Application Priority Data

Aug. 20, 1975 Netherlands ..... 7509882

[52] U.S. Cl. ..... 343/781 P; 343/837

[51] Int. Cl.[2] ..... H01Q 19/14

[58] Field of Search ..... 343/781 P, 781 CA, 781, 343/840, 837

[56] References Cited

UNITED STATES PATENTS

| | | | |
|---|---|---|---|
| 2,703,506 | 3/1955 | Kelly | 343/837 |
| 3,953,858 | 4/1976 | Ohm | 343/837 |

*Primary Examiner*—Alfred E. Smith
*Assistant Examiner*—David K. Moore
*Attorney, Agent, or Firm*—Watson, Cole, Grindle & Watson

[57] ABSTRACT

An antenna for "frequency-re-use" that is provided with more than two parabolic cylinder surfaces (as reflectors), having in pairs common line foci, which foci intersect or cross each other, and having in pairs common symmetry planes.

2 Claims, 2 Drawing Figures

PARABOLIC ANTENNA

BACKGROUND OF THE INVENTION

The invention relates to an antenna comprising a number of parabolic cylinder surfaces as reflectors, which are mounted confocally with a common plane of symmetry and a radiator, which can emit a substantially plane wave, whose plane is substantially perpendicular to the plane of symmetry of the reflectors next to the radiator in the path of rays.

Such an antenna is known in the art. This known antenna applies two parabolic cylinder surfaces.

SUMMARY OF THE INVENTION

The object of the invention is an antenna, i.a. also suitable for the so-called frequency-re-use techniques, in which two different directions of polarisation are used at the same frequency. For that purpose the interaction between both directions of polarisation ought to have a very low value.

Surprisingly, it was found that, admittedly, the antenna known in the art has this property, but also that it does not display a spreading of the beam in one of the two directions.

Therefore, the object of the invention is in particular an antenna with an independent beam spreading in both directions, so that symmetric and asymmetric beams can be formed.

Therefore, the invention is characterized in that the antenna comprises more than two substantially parabolic cylinder surfaces, each pair of which has in common one line focus and one plane of symmetry, the line-foci intersecting or crossing each other.

The invention will now further be elucidated with reference to a drawing with two figures.

BRIEF DESCRIPTION OF THE DRAWINGS

FIG. 1 schematically shows a main reflector 1 and a subreflector 2, in a set-up known in the art. Reflectors

Figure 1:
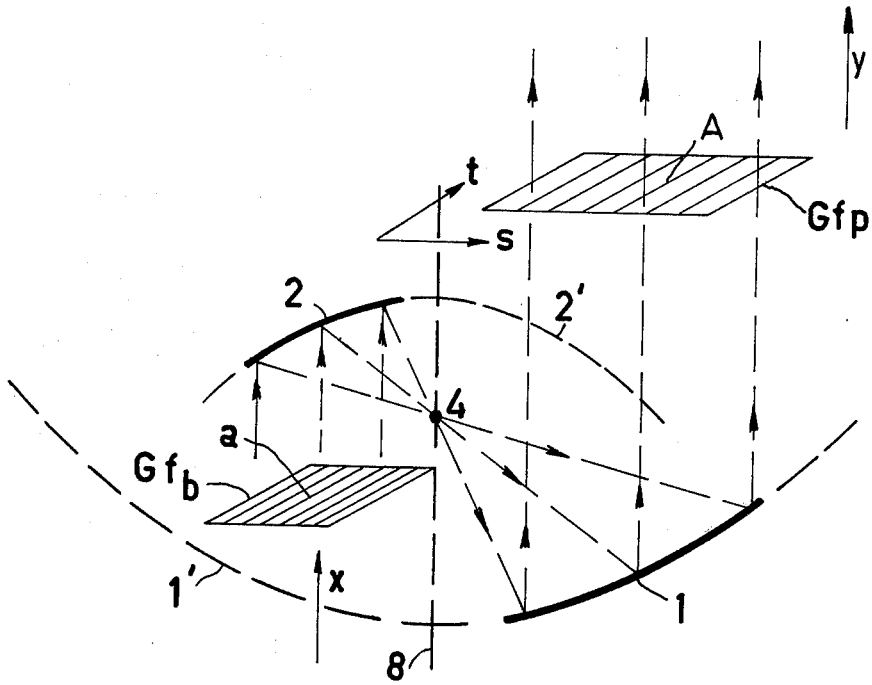
FIG. 1 schematically shows the principle upon which the invention is based.

1 and 2 are sections of the substantially parabolic cylinder surfaces, which are drawn according to broken lines 1' and 2' and have a common line focus 4 in the common plane of symmetry.

This common plane of symmetry of cylinder surfaces 1' and 2' is indicated by broken line 8.

A plane wave front $Gf_b$ that is incident at reflector 2, parallel to plane 8, in the direction of propagation $x$ of the source that has not been drawn, is reflected by this reflector 2 towards reflector 1 via common focal line 4 and emerges again from this reflector 1, parallel to surface 8 in direction of propagation $y$ of the system, as an enlarged plane wave front $Gfp$.

Wave fronts $Gf_b$ and $Gfp$ both are shown schematically in perspective. Wave front $Gfp$ is enlarged in direction $s$, whereas in direction $t$ it has not been changed. In so doing, the original square front $Gf_b$ has become a rectangular front $Gfp$.

A point $a$ in front $Gf_b$ at a certain spot (on the third line of an imaginative screen on this front) appears (on the third line of a screen imaginatively enlarged) in front $Gfp$ as a point A on a corresponding place.

Figure 2:
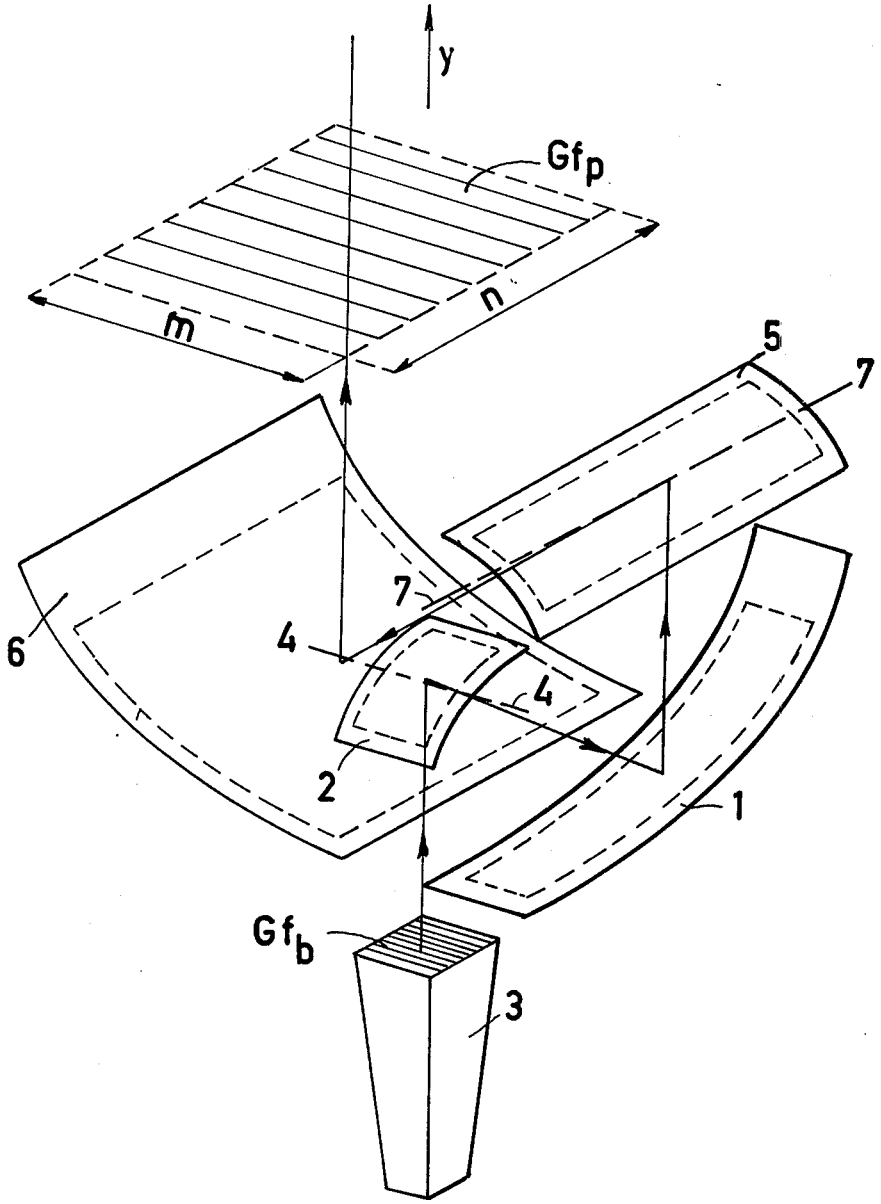
FIG. 2 represents an embodiment of the invention with four reflectors, which in pairs have common line-foci, which line-foci cross each other perpendicularly, and are lying in different planes of symmetry. In the figures like ciphers and letters refer to like elements.

In FIG. 2 an embodiment of the invention is drawn, in which use has been made of the system as an emitter.

By the application of two additional reflectors 5 and 6 that have a common line focus 7 in a common plane of symmetry that is not drawn, a symmetrical plane wave front ($n=m$) can be realized. In this case the planes of symmetry intersect each other perpendicularly and line-foci 4 and 7 cross or intersect each other perpendicularly.

I claim:

1. An antenna, comprising a number of parabolic cylinder surfaces as reflectors, which are mounted confocally with a common plane of symmetry and a radiator that can emit a substantially plane wave, whose plane is substantially perpendicular to the plane of symmetry of the reflectors next to the radiator in the path of rays, wherein the antenna comprises more than two substantially parabolic cylinder surfaces, each pair of which has in common one line-focus and one plane of symmetry, the line-foci intersecting or crossing each other.

2. An antenna according to claim 1, wherein the line-foci intersect or cross each other perpendicularly.

* * * * *